US007878443B2

(12) United States Patent
Chung

(10) Patent No.: US 7,878,443 B2
(45) Date of Patent: Feb. 1, 2011

(54) YARN CHANGING METHOD IN A WARPING MACHINE WITH YARN CHANGING UNIT

(75) Inventor: Jih-Lung Chung, TuCheng (TW)

(73) Assignee: CCI Tech Inc., Taipei (TW)

( * ) Notice: Subject to any disclaimer, the term of this patent is extended or adjusted under 35 U.S.C. 154(b) by 436 days.

(21) Appl. No.: 11/480,941

(22) Filed: Jul. 6, 2006

(65) Prior Publication Data

US 2007/0138332 A1 Jun. 21, 2007

(30) Foreign Application Priority Data

Dec. 20, 2005 (TW) ..... 94145266 A

(51) Int. Cl.
*B65H 67/00* (2006.01)

(52) U.S. Cl. ..... 242/559; 242/560; 242/131.1; 28/190; 28/193

(58) Field of Classification Search ..... 242/473.4, 242/474, 474.2, 475.1, 475.5, 475.6, 551, 242/554, 554.2, 556, 563, 558, 559, 559.1, 242/559.3, 560, 560.2, 560.3, 131, 131.1; 28/190, 193, 201, 209, 184
See application file for complete search history.

(56) References Cited

U.S. PATENT DOCUMENTS 5,000,231 A * 3/1991 Takehana et al. ..... 139/450
5,297,323 A * 3/1994 Jaeggi ..... 28/211
6,233,798 B1 * 5/2001 Bogucki-Land ..... 28/190
6,845,550 B2 * 1/2005 Kimura et al. ..... 28/184

FOREIGN PATENT DOCUMENTS

DE 10029492 A1 * 1/2002

OTHER PUBLICATIONS

Machine translation of DE 10029492 A1.*

* cited by examiner

*Primary Examiner*—William E Dondero
(74) *Attorney, Agent, or Firm*—Muncy, Geissler, Olds & Lowe, PLLC

(57) ABSTRACT

A yarn-changing method in a warping machine having yarn-changing units is disclosed. The yarn-changing method includes steps of (a) stopping a rotary creel having a plurality of working yarn packages and preparing one of the yarn packages for color changing; (b) sucking a yarn of the original yarn package; (c) clipping the yarn of the original yarn package and delivering it to a connecting unit; (d) taking a new color-changing yarn package from a storing creel by a swing arm for changing and then delivering a yarn of the new yarn package to the connecting unit; (e) connecting the yarns of step (c) and step (d); and (f) starting the rotary creel for wrapping, thereby changing one of working yarn packages with one of new color-changing yarn packages efficiently.

6 Claims, 4 Drawing Sheets

YARN CHANGING METHOD IN A WARPING MACHINE WITH YARN CHANGING UNIT

BACKGROUND OF THE INVENTION (a) Field of the Invention

The present invention relates to a yarn-changing method in a warping machine with yarn changing units, particularly to an automatic yarn-changing and color-changing method in a warping machine with yarn changing units.

(b) Description of the Prior Art

Generally speaking, in the conventional preparation of sample fabrics for customers in the textile industry, it is necessary to cut several yarns at the same length from yarn packages with reference to the required length and quantity of yarns. If ten thousand yarns are needed, ten yarn packages are used, such that when working each yarn package by the same operations for one thousand times, ten thousand yarns can be made. Then these ten thousand yarns at the same length are wound around a warp beam to form the warp required for weaving. This step is called a warping step. Finally, the warp is crisscross woven with a woof to form knitted fabrics. Therefore, the warping step is the most important procedure in the warp preparation process. This step is to wind a plurality of warps at a specified length horizontally around a warp beam at a specified working width. Consequently, the main objective of the warping procedure is to make the tension of all the warps wound on the warp beam uniform and constant without changes in the entire warping process; otherwise, this will cause broken ends during the weaving process and inaccurate fabric structures. Moreover, this procedure also makes all the warps evenly and horizontally arranged on the warp beam in order to make the warp beam accurately wound into a cylindrical shape, avoid the wearing of warps in the entire warping procedure, maintain the physical and mechanical properties of warps, and enhance the production efficiency of the warping machine as far as possible.

However, due to the limitation of the machine, drawbacks are inherent in the conventional warping method. They are: (1) it fails to ensure uniform warp tension or (2) it fails to ensure uniform warp tension during the entire yarn package unwinding process. In fact, the creel structure in the warping machine is required to achieve uniform tension, winding, and arrangement. Generally speaking, creels can be classified into rotary creels, flat creels, and composite creels comprising both rotary creels and flat creels. However, during operations, the working of the warping machine is limited by the working of the creel, thereby unable to be efficiently applied. For conventional warping machines having creels, although rotary creels are at high speed and can process a plurality of yarns simultaneously, they remain to be limited by their creel structures, thereby unable to change yarn and yarn color automatically. To perform the color-changing process, on the one hand, it is required to stop the machine and perform the color-changing preparations. Therefore, it is time consuming. On the other hand, for conventional warping machines having flat creels, the working of flat creels is slower, such that only one yarn can be prepared for color changing at one time. Although it is easy to change yarn color for flat creels, they are less efficient. If the aforementioned composite creel comprising both the rotary creel and flat creel are independently set up, the rotary and flat creel simultaneously work together, such that during color changing, it is required to lower the speed of the machine and choose only one color as the primary color. Moreover, it is even more time consuming to change the creel, thereby failing to effectively perform the color-changing process.

Consequently, the object is to develop an integrated yarn-changing method in a warping machine having yarn changing units, thereby enhancing the efficiency of the yarn-changing procedure for the entire warping machine, speeding up the warping process, and changing yarns and yarn color more efficiently.

SUMMARY OF THE INVENTION

To overcome the abovementioned drawbacks, the primary object of the present invention is to provide an integrated yarn-changing method in a warping machine having yarn changing units, thereby enhancing the efficiency of the yarn-changing procedures for the entire warping machine, speeding up the warping process, and changing yarns and yarn color more efficiently.

To achieve the abovementioned object, the present invention provides a yarn-changing method in a warping machine having yarn-changing units. The yarn-changing method comprises the steps of (a) stopping a rotary creel having a plurality of working yarn packages and preparing one of the yarn packages for color changing; (b) sucking a yarn of the original yarn package; (c) clipping the yarn of the original yarn package and delivering it to a connecting unit; (d) taking a new color-changing yarn package from a storing creel by a swing arm for changing and then delivering a yarn of the new yarn package to the connecting unit; (e) connecting the original yarns of step (c) and the new color-changing yarns in step (d); and (f) starting the rotary creel for wrapping, thereby changing one of working yarn packages with one of color-changing yarn packages efficiently.

The present invention provides a yarn-changing method in a warping machine having yarn-changing units, wherein the rotary creel is driven by a power motor.

The present invention provides a yarn-changing method in a warping machine having yarn-changing units, wherein the yarn of the original yarn package in step (b) is sucked by negative pressure through a negative pressure picker.

The present invention provides a yarn-changing method in a warping machine having yarn-changing units, wherein step (b) further comprises a step (b1) to determine and detect by a sensor if the yarn of the original yarn package is ready for color changing.

The present invention provides a yarn-changing method in a warping machine having yarn-changing units, wherein the yarn of the original yarn package in step (c) is clipped and cut by a clipping and cutting unit.

The present invention provides a yarn-changing method in a warping machine having yarn-changing units, wherein the yarn of the original yarn package in step (c) is delivered to the connecting unit by a picking and feeding device.

The present invention provides a yarn-changing method in a warping machine having yarn-changing units, wherein the new color-changing yarn package in step (d) is taken from a storing creel having a plurality of new color-changing yarn packages by a swing arm for changing color.

The present invention provides a yarn-changing method in a warping machine having yarn-changing units, wherein the new color-changing yarn package in step (d) is clipped by a picking and feeding device and delivered to the connecting unit.

To enable a further understanding of the objectives and the technological methods of the invention herein, the brief description of the drawings below is followed by the detailed description of the preferred embodiments.

DETAILED DESCRIPTION OF THE PREFERRED EMBODIMENTS

Figure 1:
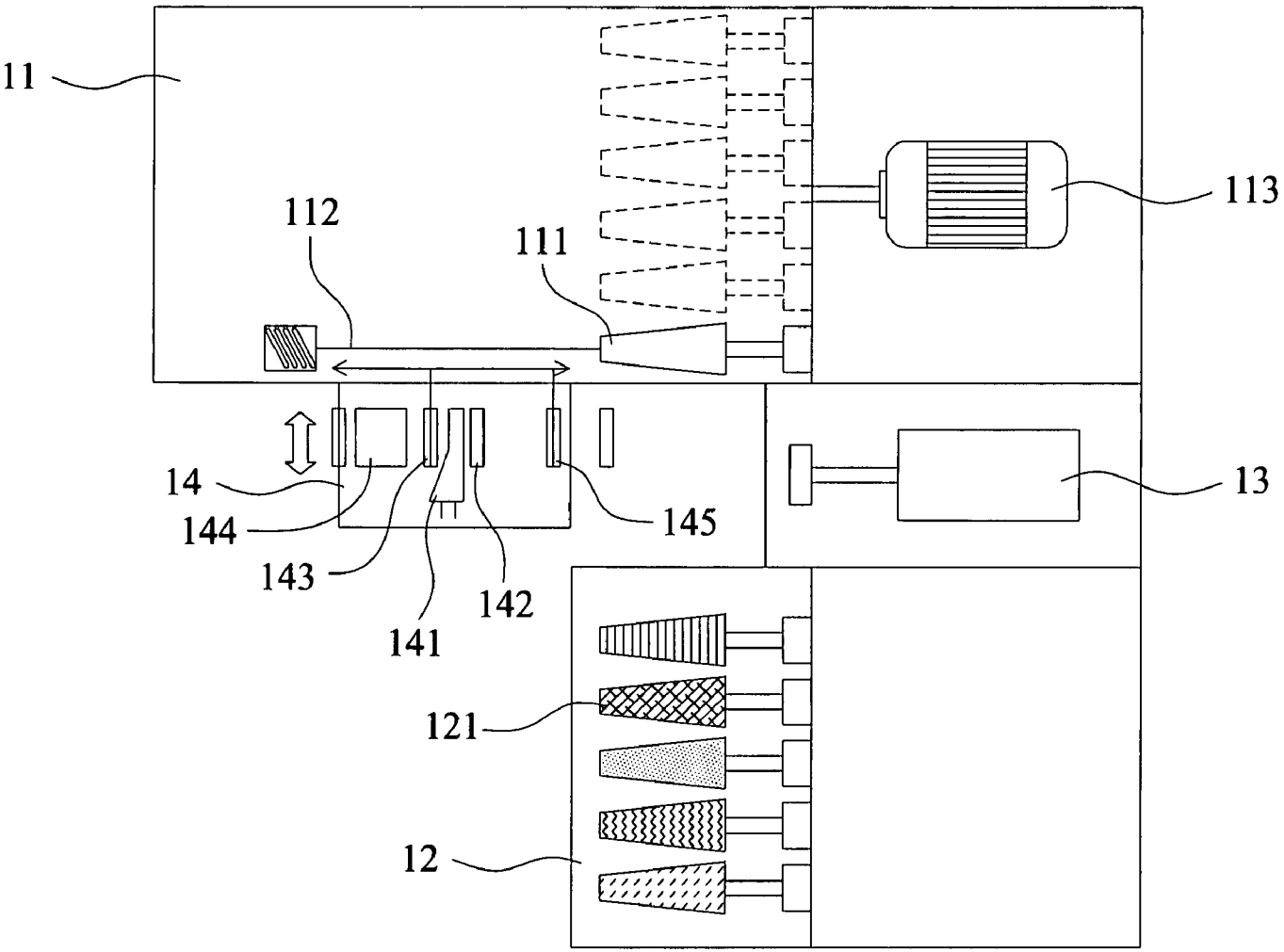
FIG. 1 shows a yarn-changing device in a warping machine having yarn-changing units disclosed in a first preferred embodiment of the present invention.
Figure 2:
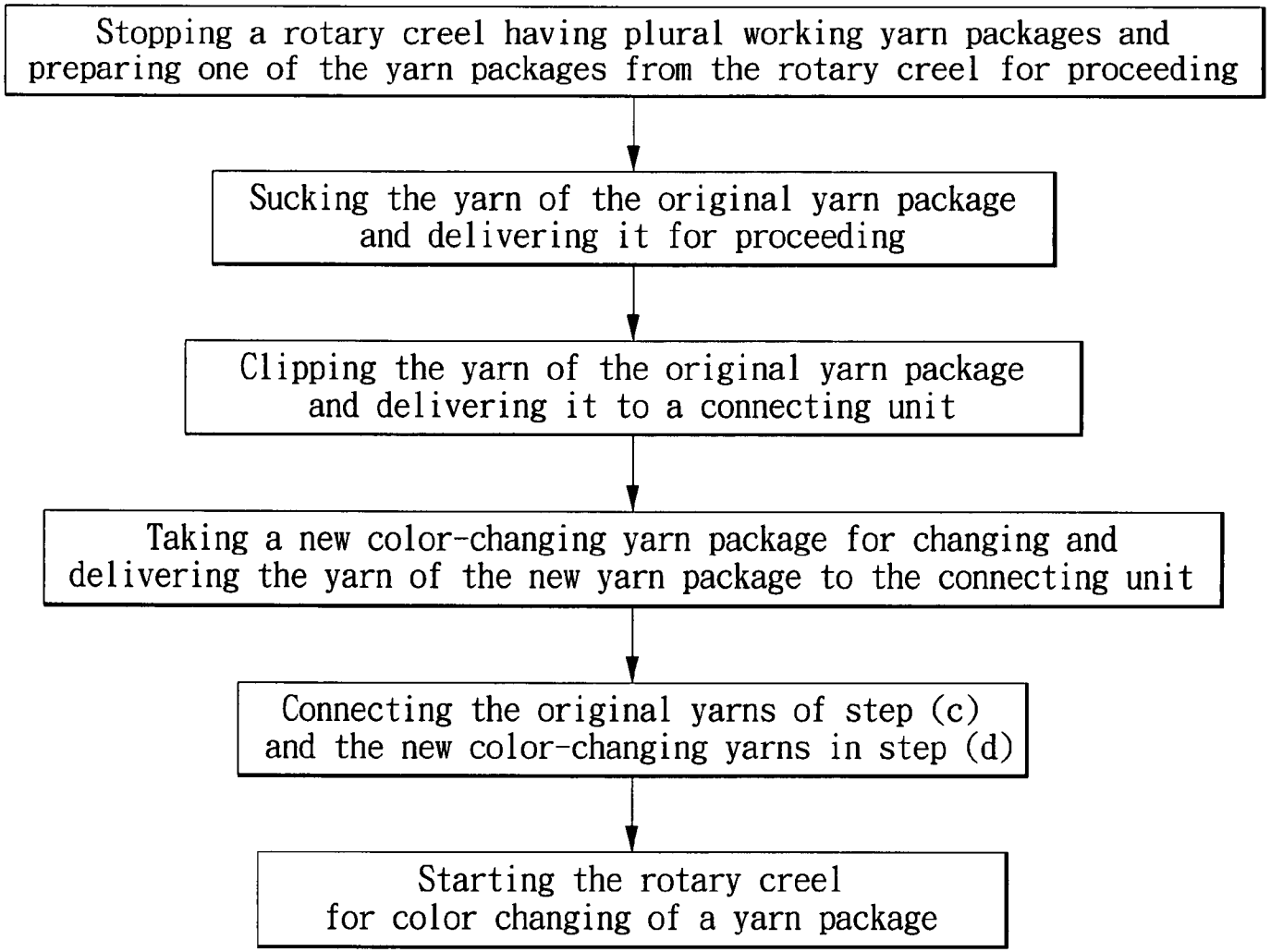
FIG. 2 shows a yarn-changing method in a warping machine having yarn-changing units disclosed in a first preferred embodiment of the present invention.

Referring to FIG. 1, the structure of the yarn-changing device in a warping machine having yarn-changing units disclosed in a first preferred embodiment of the present invention comprises a rotary creel 11, having a plurality of working yarn packages 111 provided circumferentially thereon to lead a yarn 112 into the warping procedure; a storing creel 12, having a plurality of new color-changing yarn packages 121 therein; a swing arm 13, and a color-changing module 14. Referring to FIG. 2, the yarn-changing method in a warping machine disclosed in a first preferred embodiment of the present invention comprises the steps of (a) stopping a working rotary creel 11 having a plurality of working yarn packages 111 provided circumferentially thereon and preparing one of the working yarn packages 111 for color changing; (b) making the color-changing module 14 ready for proceeding by sucking a yarn 112 of the original yarn package 111 and delivering the yarn 112 for proceeding; (c) making the color-changing module 14 clip the yarn 112 of the original yarn package 111, cutting the yarn 112 of the original yarn package 111, and delivering it to a connecting unit 144; (d) delivering the original yarn package 111 by the swing arm 13, taking a new color-changing yarn package 121 from a storing creel 12 for color changing (it is also possible to deliver the removed original yarn package 111 to the storing creel 12), clipping a yarn 112 of the new color-changing yarn package 121 by the color-changing module 14 and then delivering it to the connecting unit 144; (e) connecting the yarns 112 of step (c) and the yarns 112 from the new color-changing yarn package 121 of step (d) by the connecting unit 144; and (f) restoring the color-changing module 14 to the original proceeding location and starting the rotary creel 11 for wrapping, thereby changing one of working yarn packages with one of color-changing yarn packages efficiently.

During actual applications, the rotary creel 11 is driven by a power motor 113, wherein the yarn 112 of the original yarn package 111 of step (b) is sucked by negative pressure through a negative pressure picker 141 of the color-changing module 14. Step (b) further comprises a step (b1) to determine and detect by a sensor 142 if the yarn 112 of the original yarn package 111 is ready for proceeding. Then the yarn 112 of the original yarn package 111 of step (c) is first clipped and cut by a clipping and cutting unit 143, and then delivered to the connecting unit 144 by a picking and feeding device 145. Finally, the yarn 112 of the new color-changing yarn package 121 of Step (d) is clipped by a picking and feeding device 145 and delivered to the connecting unit 144, thereby enhancing the efficiency of the yarn-changing procedures for the entire warping machine, speeding up the warping process, and changing yarns and yarn color more efficiently.

In other words, once an operator starts the yarn-changing operations of the warping machine, the color-changing module 14 can proceed with the operations. First, the negative pressure picker 141 sucks the yarn 112 for proceeding by a negative pressure sucking head. Then the sensor 142 is used to accurately detect and determine if the yarn 112 is ready for color changing. The yarn 112 is clipped and cut by the clipping and cutting unit 143 and delivered to a side of the connecting unit 144 by the picking and feeding device 145. After delivering the new color-changing yarn package 121 by the swing arm 13, the yarn 112 of the new color-changing yarn package 121 is clipped by the picking and feeding device 145 and delivered to the connecting unit 144. Finally, the color-changing module 14 is restored to its original proceeding location and the rotary creel 11 resumes its original working speed for wrapping. With the help of the rotary creel 11 and the color-changing module 14, it is possible to overcome the drawback of the rotary creel 11 on color changing and maintain a high speed for it (it is possible to provide more than 12 yarns simultaneously.) If more yarns are required to be expanded in the warping machine, multiple color-changing modules 14 can be used for replacement.

Figure 3:
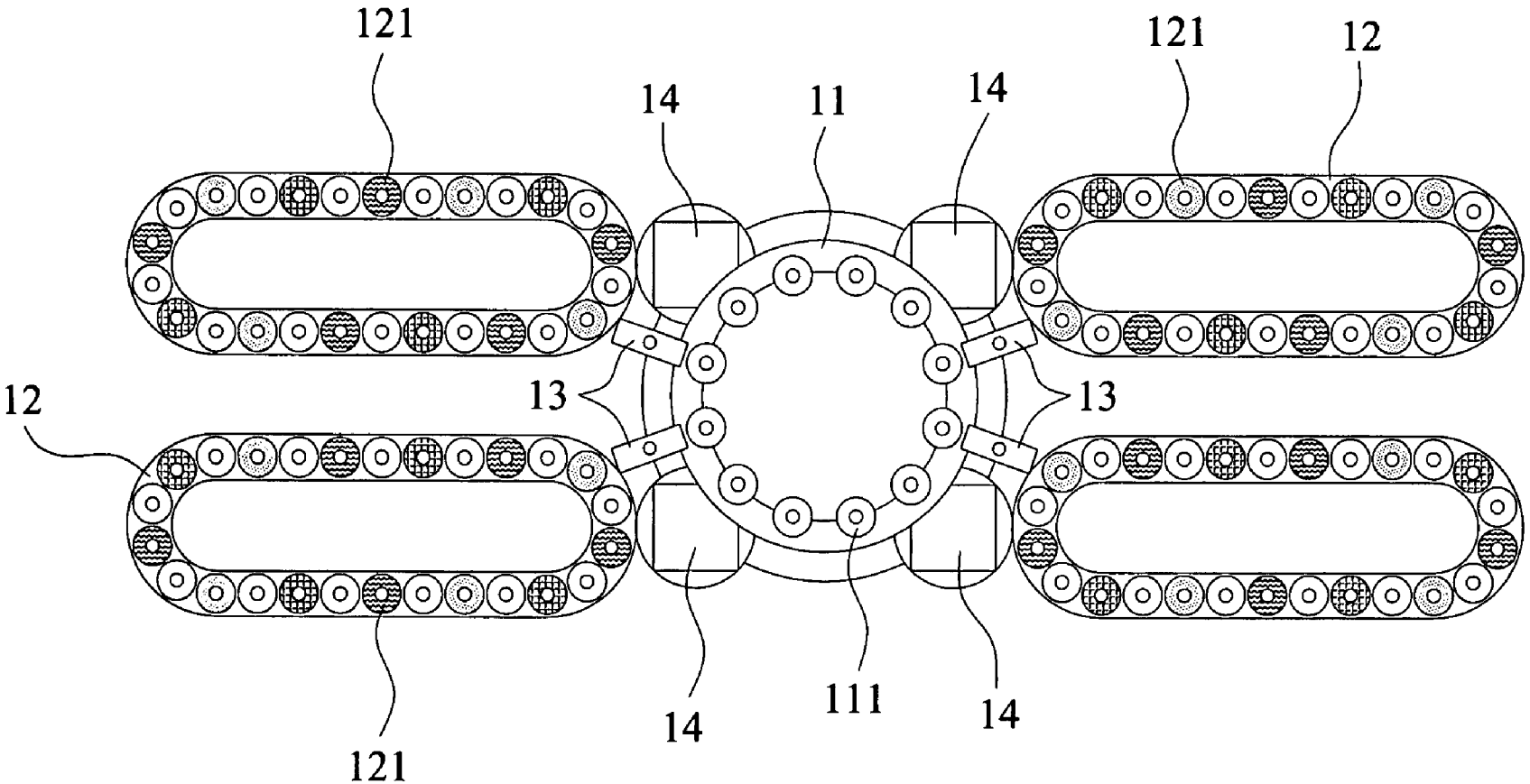
FIG. 3 shows a yarn-changing device in a warping machine having yarn-changing units disclosed in a second preferred embodiment of the present invention.

Referring to FIG. 3, the yarn-changing device in a warping machine disclosed in a second preferred embodiment of the present invention comprises a rotary creel 11, having a plurality of working yarn packages 111 provided circumferentially thereon to lead a yarn 112 into the warping procedure; four storing creels 12, having a plurality of new color-changing yarn packages 121 therein; four swing arms 13, and four color-changing modules 14. Contrary to the aforementioned embodiment, the present invention provides a yarn-changing method in a warping machine comprises steps of (a) stopping a working rotary creel 11 having a plurality of working yarn packages 111 and preparing one of the yarn packages 111 for color changing; (b) sucking a yarn 112 of the original yarn package 111 and delivering the yarn 112 for proceeding; (c) clipping and cutting the yarn 112 of the original yarn package 111 and delivering it to a connecting unit 144 corresponding to the plurality of the original yarn packages 111; (d) delivering a plurality of new color-changing yarn packages 121 to the respective plurality of original yarn packages 111 for proceeding, clipping a yarn 112 of the new color-changing yarn package 121 and then delivering the yarn 112 of the new yarn package 121 to the connecting unit 144; (e) connecting the yarns 112 of step (c) and the respective yarns 112 from the new color-changing yarn package 121 of step (d) by the connecting unit 144; and (f) starting the rotary creel 11 to change color for a plurality of yarn packages. The four storing creels 12, the four swing arms 13, and the four color-changing modules 14 can simultaneously work.

During actual applications, the rotary creel 11 is driven by a power motor 113, wherein the respective yarn 112 of the original yarn package 111 of step (b) is sucked by negative pressure through a negative pressure picker 141 of the color-changing module 14. Step (b) further comprises a step (b1) to determine and detect by a sensor 142 if the yarn 112 of the original yarn package 111 is ready for proceeding. Then the yarn 112 of the original yarn package 111 of step (c) is first clipped and cut by a clipping and cutting unit 143 and then delivered to the connecting unit 144 by a picking and feeding device 145. Finally, the yarn 112 of the new color-changing yarn package 121 of step (d) is clipped by a picking and feeding device 145 and delivered to the connecting unit 144.

According to another embodiment of the present invention, the present invention provides a yarn-changing method in a warping machine comprises steps of (a) stopping a working rotary creel 11; (b) selecting one original yarn package 111 from the plurality of original yarn packages 111 from the rotary creel 11 and delivering it for proceeding; (c) sucking a yarn 112 of the original yarn package 111 and delivering it for proceeding; (d) clipping and cutting the yarn 112 of the original yarn package 111 and delivering it to a connecting unit 144; (e) delivering a new color-changing yarn package 121 for proceeding, clipping a yarn 112 of the new color-changing yarn package 121 and then delivering the yarn 112 of the new yarn package 121 to the connecting unit 144; (f) connecting the yarns 112 of step (d) and the respective yarns 112 from the new color-changing yarn package 121 of step (e) by the connecting unit 144; (g) selecting another original yarn package 111 from the rotary creel 11 and delivering it for proceeding; repeating step (c) to step (f) until the plurality of original yarn packages 111 from the rotary creel 11 have been processed; (h) starting the rotary creel 11 to change color for a plurality of yarn packages. According to the present embodiment, only one storing creel 12, one swing arm 13, and one color-changing module 14 can simultaneously work to complete the color-changing procedure.

Figure 4:
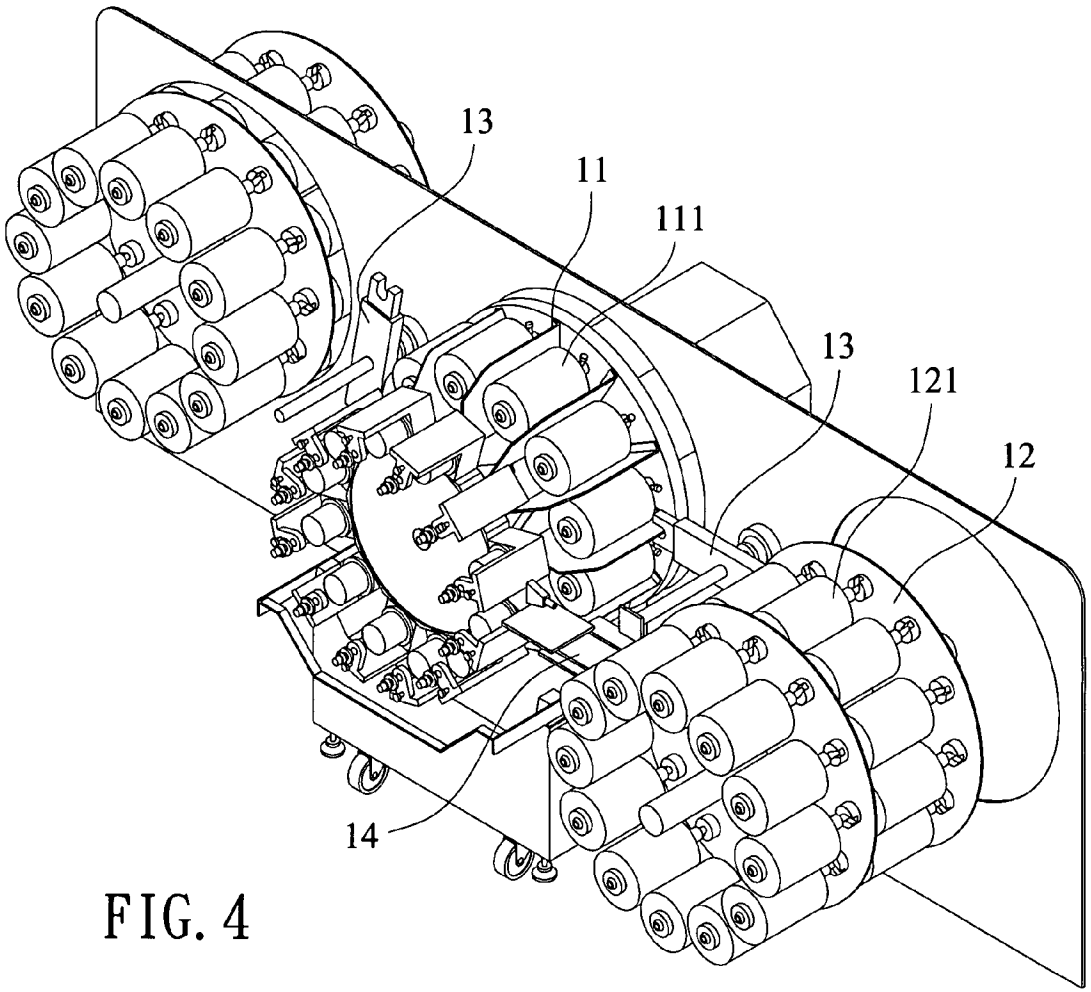
FIG. 4 shows a yarn-changing device in a warping machine having yarn-changing units disclosed in a third preferred embodiment of the present invention.

Referring to FIG. 4, a yarn-changing device in a warping machine according to a third preferred embodiment of the present invention is disclosed. The basic structure of the present embodiment is similar to the aforementioned yarn-changing device, but differs in that the present embodiment provides a device having two double-layer storing creels 12, such that the layers of the double-layer storing creel 12 can move forward and backward to select the required new color-changing yarn package 121 and hold it by the swing arm 13 for replacement. In addition, the present invention provides a yarn-changing method in a warping machine comprises the steps of (a) stopping a working rotary creel 11; (b) selecting one original yarn package 111 from the plurality of original yarn packages 111 from the rotary creel 11 and delivering it for proceeding; (c) sucking a yarn 112 of the original yarn package 111 and delivering it for proceeding; (d) clipping and cutting the yarn 112 of the original yarn package 111 and delivering it to a connecting unit 144; (e) moving the layers of the storing creel 12, selecting one new color-changing yarn package 121 and delivering it for proceeding, clipping a yarn 112 of the new color-changing yarn package 121 and then delivering the yarn 112 of the new yarn package 121 to the connecting unit 144; (f) connecting the yarns 112 of step (d) and the respective yarns 112 from the new color-changing yarn package 121 of step (e) by the connecting unit 144; (g) selecting another original yarn package 111 from the rotary creel 11 and delivering it for proceeding; repeating step (c) to step (f) until the plurality of original yarn packages 111 from the rotary creel 11 have been processed; (h) starting the rotary creel 11 to change color for a plurality of yarn packages. According to the present embodiment, only one storing creel 12, one swing arm 13, and one color-changing module 14 can simultaneously work to complete the color-changing procedure. Moreover, the present embodiment further provides a multi-layer storing creel 12 for more options on color changing.

In summary, the present invention provides an integrated yarn-changing method in a warping machine, thereby enhancing the efficiency of the yarn-changing procedure for the entire warping machine, speeding up the warping process, and changing yarns and yarn color more efficiently.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A yarn-changing method in a warping machine having yarn-changing units, comprising steps of:

(a) stopping rotation of a rotary creel having a plurality of working yarn packages and preparing a yarn package from the rotary creel for proceeding;

(b) sucking a yarn of the original yarn package and delivering the yarn for proceeding, including determining and detecting by using a sensor if the yarn of the original yarn package is ready for proceeding;

(c) clipping the yarn of the original yarn package and delivering the yarn to a connecting unit;

(d) taking a new color-changing yarn package for proceeding and then delivering a yarn of the new color-changing yarn package to the connecting unit;

(e) connecting the yarn of step (c) and the yarn from the new color-changing yarn package of step (d) by the connecting unit; and (f) starting rotation of the rotary creel to change the color of one yarn package in the warping machine, wherein the new color-changing yarn package in step (d) is taken from a storing creel having a plurality of new color-changing yarn packages by a swing arm for changing color.

2. The yarn-changing method in a warping machine having yarn-changing units as claimed in claim 1, wherein the rotary creel is driven by a power motor.

3. The yarn-changing method in a warping machine having yarn-changing units as claimed in claim 1, wherein the yarn of the original yarn package in step (b) is sucked by negative pressure through a negative pressure picker.

4. The yarn-changing method in a warping machine having yarn-changing units as claimed in claim 1, wherein the yarn of the original yarn package in step (c) is clipped and cut by a clipping and cutting unit.

5. The yarn-changing method in a warping machine having yarn-changing units as claimed in claim 4, wherein the yarn of the original yarn package in step (c) is delivered to the connecting unit by a picking and feeding device.

6. The yarn-changing method in a warping machine having yarn-changing units as claimed in claim 1, wherein the yarn of the new color-changing yarn package in step (d) is clipped by a picking and feeding device and delivered to the connecting unit.

* * * * *